United States Patent [19]

Garbelman et al.

[11] 4,147,436

[45] Apr. 3, 1979

[54] METHOD AND APPARATUS FOR PRODUCING HOT MIX ASPHALT UTILIZING RECYCLABLE ASPHALT AGGREGATE

[75] Inventors: David L. Garbelman, Edmond; William H. Minor, Bethany; Arthur G. Shaw, Mustang, all of Okla.

[73] Assignee: CMI Corporation, Oklahoma City, Okla.

[21] Appl. No.: 880,712

[22] Filed: Feb. 23, 1978

Related U.S. Application Data

[63] Continuation-in-part of Ser. No. 828,498, Aug. 29, 1977, abandoned.

[51] Int. Cl.[2] ..... B28C 1/22

[52] U.S. Cl. ..... 366/25; 106/281 R

[58] Field of Search ..... 366/4, 7, 10–12, 366/22–25, 144, 145, 147; 106/280, 281 R, 273 R; 404/90, 92, 95

[56] References Cited

U.S. PATENT DOCUMENTS

| | | | |
|---|---|---|---|
| 3,999,743 | 12/1976 | Mendenhall | 366/4 |
| 4,025,057 | 5/1977 | Shearer | 366/11 |
| 4,075,710 | 2/1978 | Jakob et al. | 366/25 |

*Primary Examiner*—Leonard D. Christian
*Attorney, Agent, or Firm*—Dunlap, Codding & McCarthy

[57] ABSTRACT

An improved method and apparatus for producing hot mix asphalt utilizing new aggregate and a previously manufactured and laid asphalt mix which has been reduced to form recyclable aggregate, wherein the new aggregate is fed into the input end of a rotating mixer drum and cascaded repeatedly through a flame extending from the input end of the mixer drum to a first medial portion thereof and the recyclable aggregate is fed radially into the mixer drum at a second medial portion thereof intermediate the first medial portion and the output end of the mixer drum, the new aggregate shielding the mixer drum from the flame and confining the flame to the portion of the mixer drum between the input end and the first medial portion thereof.

23 Claims, 10 Drawing Figures

METHOD AND APPARATUS FOR PRODUCING HOT MIX ASPHALT UTILIZING RECYCLABLE ASPHALT AGGREGATE

CROSS-REFERENCE TO RELATED APPLICATIONS

The subject matter of this application is related to the subject matter disclosed in U.S. Patent application No. 775,388 entitled "Apparatus for Producing Hot Mix Asphalt Utilizing Recyclable Asphalt Aggregate", filed Mar. 7, 1977, by Herbert E. Jakob and David L. Garbelman, assigned to the Assignee of the present application and issuing as U.S. Pat. No. 4,075,710 on Feb. 21, 1978. Further, this application is a continuation-in-part of U.S. Patent application Ser. No. 828,498, filed Aug. 29, 1977, and now abandoned by David L. Garbelman, William H. Minor and Arthur G. Shaw, entitled "Apparatus for Producing Hot Mix Asphalt Utilizing Recyclable Asphalt Aggregate", and being assigned to the Assignee of the present application.

BACKGROUND OF THE INVENTION

1. Field of the Invention

This invention relates generally to improvements in methods and apparatus for producing hot mix asphalt and, more particularly, but not by way of limitation, to an improved method and apparatus for producing hot mix asphalt utilizing new aggregate and a previously manufactured and laid asphalt mix which has been reduced to form recyclable aggregate wherein the new aggregate is employed to protect the mixing apparatus and the recyclable aggregate from excessive temperatures.

2. Description of the Prior Art

As was pointed out in the description of the prior art presented in U.S. Patent applications Ser. Nos. 775,388 and 828,498, various methods and apparatus for utilizing previously manufactured and laid asphalt mix which has been reduced to form recyclable aggregate are well known in the art. However, the various methods and apparatus proposed heretofore have been generally unsatisfactory for one or more of the following reasons:

1. Cleanliness. With the growing awareness of the fragility of our environment, increasingly stringent limitations have been placed on the amount of air-borne pollutants introduced into the atmosphere through the operation of asphalt producing devices. This problem is particularly acute in asphalt recycling devices due to the tendency of the hydrocarbon portion of the recyclable aggregate to decompose at elevated temperatures thereby producing excessive amounts of smoke.

2. Productivity. Rapidly rising labor and machinery costs virtually demand that each piece of paving machinery and crews therefor be kept busy at useful tasks as much as possible. However, the low rates of production generally characteristic of currently proposed recycling methods and apparatus is basically incompatible with this commercial reality.

3. Versatility. In order to be commercially feasible, an asphalt plant capable of utilizing recycled material must also be capable of producing hot mix asphalt using only conventional, new aggregate without a reduction in capacity. Due to the temperature sensitivity of recyclable asphalt aggregate, it has been generally proposed to limit the exposure of the recyclable material to the heating medium through various mechanical devices. However, such devices commonly restrict the operation of the mixing device when employed in conventional hot mix operations. The resultant lack of versatility severely restricts the scope of applicability of such methods and apparatus.

4. Efficiency. Besides making most effective use of the hardware provided, efficiency implies minimum consumption of energy resources in the production of a given quantity of hot mix asphalt. For various reasons, the presently proposed methods and apparatus generally require expensive, additional hardware or consume excessive amounts of energy in efforts to limit the exposure of the recyclable asphalt aggregate to excessive temperatures.

SUMMARY OF THE INVENTION

The present invention contemplates an improved method and apparatus for producing hot mix asphalt utilizing new aggregate and a previously manufactured and laid asphalt mix which has been reduced to form recyclable aggregate, wherein the new aggregate is fed into the input end of a rotating mixer drum and repeatedly cascaded through a flame extending through the input end of the mixer drum to a first medial portion thereof to shield the mixer drum and the recyclable asphalt aggregate from the flame as the recyclable asphalt aggregate is fed radially into a second medial portion of the mixer drum intermediate the first medial portion and the output end thereof. In one form of the method and apparatus, water is introduced into the mixer drum to further control the temperature and extent of the flame.

One object of the present invention is to provide an improved method and apparatus for producing hot mix asphalt utilizing new aggregate and a previously manufactured and laid asphalt mix which has been reduced to form recyclable aggregate.

One other object of the present invention is to provide an improved method and apparatus for producing hot mix asphalt wherein new aggregate is introduced into the input end of a rotating mixer drum and repeatedly cascaded therethrough to shield the mixer drum adjacent the flame and to shield the recyclable aggregate introduced radially through the mixer drum downstream of the flame from excessive temperatures.

Another object of the present invention is to provide an improved method and apparatus for producing hot mix asphalt utilizing recyclable aggregate without significantly polluting the environment.

Yet another object of the present invention is to provide an improved method and apparatus for producing hot mix asphalt at a relatively high production rate utilizing new aggregate, with or without recyclable aggregate.

Still another object of the present invention is to provide an improved method and apparatus for producing hot mix asphalt wherein the method and apparatus may be employed substantially equally well using either new aggregate and recyclable aggregate or only new aggregate.

One other object of the present invention is to provide an improved method and apparatus for producing hot mix asphalt wherein the method and apparatus are relatively simple and inexpensive in manufacture, repair and operation.

Other objects and advantages of the present invention will be evident from the following detailed description when read in conjunction with the accompanying drawings which illustrate various embodiments of the present invention.

BRIEF DESCRIPTION OF THE DRAWINGS

FIG. 3 is a partial cut-away, side elevational view of the recyclable aggregate feeder assembly of the present invention.

DESCRIPTION OF THE PREFERRED EMBODIMENT

Figure 1:
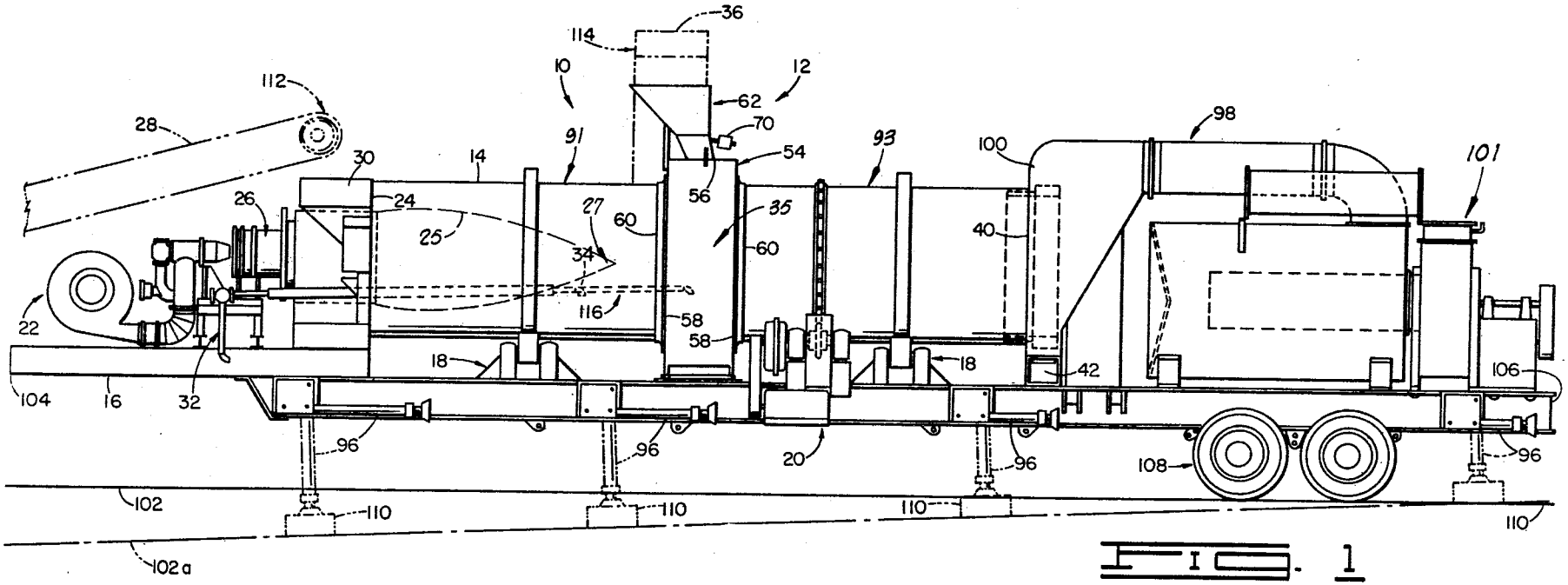
FIG. 1 is a side elevational view of an asphalt mixing apparatus constructed in accordance with the preferred embodiment of the present invention.
Figure 2:
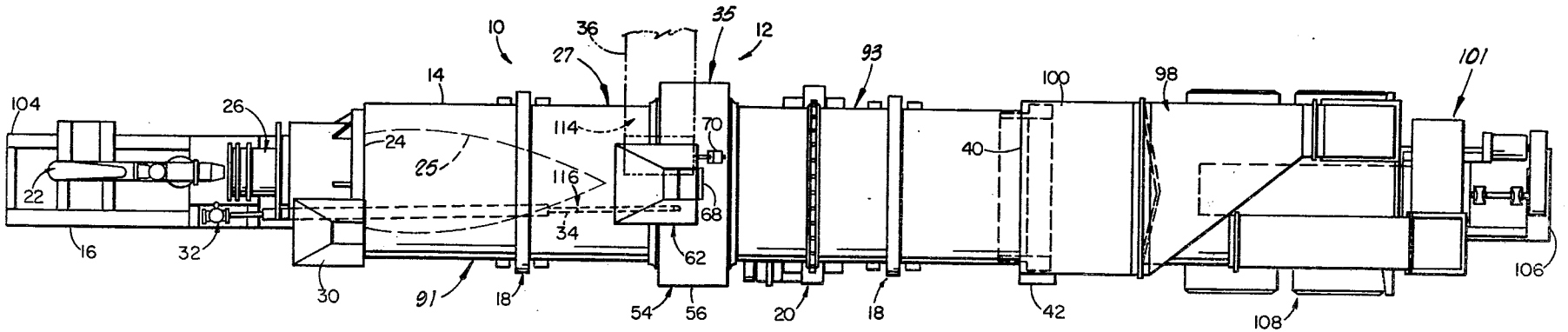
FIG. 2 is a top plan view of the mixer shown in FIG. 1.
Figure 5:
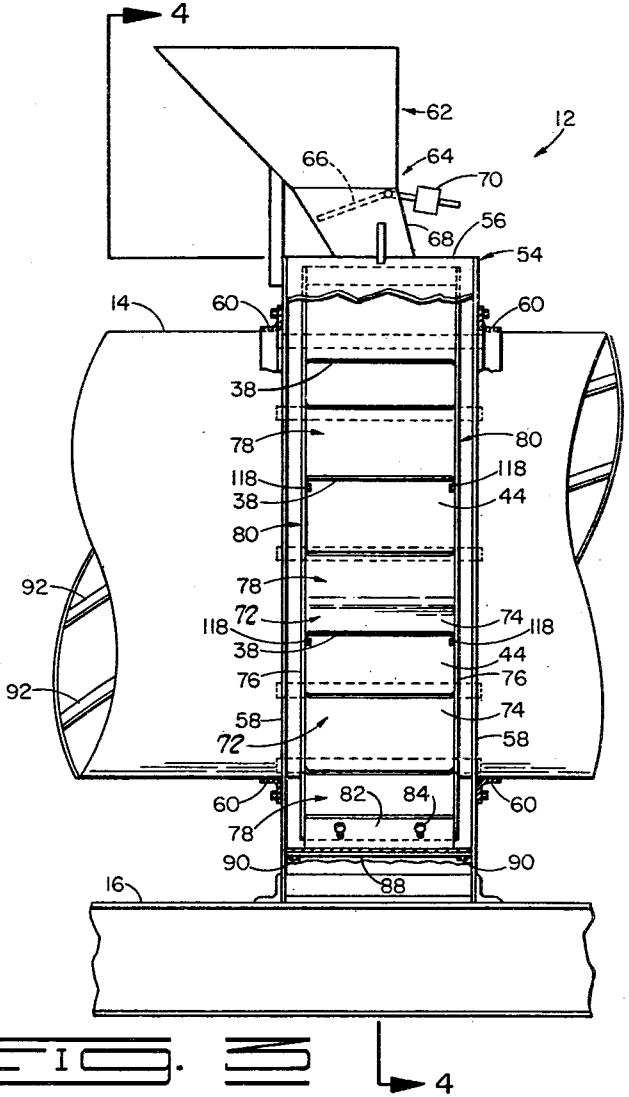
FIG. 5 is a partial cut-away view of the mixer taken along the line 5—5 in FIG. 4.
Figure 5:
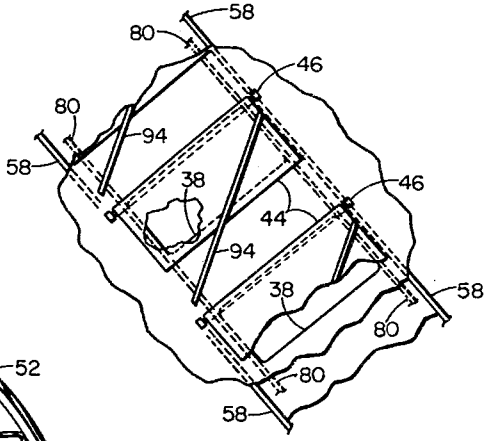

Referring to the drawings in general and to FIGS. 1 and 2 in particular, shown therein and referred to by the general reference numeral 10 is an asphalt mixing apparatus which may be conveniently utilized to practice the preferred method of the present invention. More particularly, the mixer 10 is designed to produce hot mix asphalt utilizing new aggregate and a previously manufactured and laid asphalt mix which has been reduced in some conventional manner to form recyclable aggregate. The mixer 10 is constructed substantially the same as a conventional turbulent mass mixer, such as that manufactured by and commercially available from the Assignee of the present application, except that the mixer 10 is provided with a recyclable aggregate feeder assembly 12 for feeding the recyclable aggregate into a medial portion of the mixer 10 at which the temperature is sufficiently low to preclude combustion of significant quantities of the asphaltic composition portion of the recyclable aggregate.

The mixer 10 has a cylindrical mixer drum 14 of substantially uniform diameter which is supported on a wheeled frame 16 by a plurality of bearing assemblies 18 for rotation about the longitudinal axis of the mixer drum 14 via a chain drive assembly 20. A burner assembly 22 of conventional design is mounted on the frame 16 adjacent to an input end 24 of the mixer drum 14, with a flame 25 produced by the burner assembly 22 via a pre-ignition and combustion chamber 26 extending from the input end 24 of the mixer drum 14 to a first medial portion 27 of the mixer drum 14. A new aggregate conveyor assembly 28 (shown in phantom in FIG. 1) of conventional construction is preferably provided for feeding new aggregate into the input end 24 of the mixer drum 14 via a charging hopper 30 mounted on the frame 16 adjacent the input end 24 of the mixer drum 14. An asphalt injection assembly 32 of conventional construction is also mounted on the frame 16 adjacent the input end 24 of the mixer drum 14, with an injection nozzle 34 extending through the input end 24 of the mixer drum 14 and terminating adjacent a second medial portion 35 of the mixer drum 14, so that heated asphaltic oil supplied from a suitable reservoir (not shown) may be introduced into the mixer drum 14 at a point at which the temperature is sufficiently low to preclude combustion of significant quantities of the oil.

To facilitate controlled introduction of the recyclable aggregate into the mixer drum 14 via a recyclable aggregate conveyor assembly 36 (shown in phantom in FIGS. 1 and 2), the mixer drum 14 is provided with a plurality of recyclable aggregate feeding ports 38 (hereinafter referred to for convenience as the feeding ports 38) extending radially through the mixer drum adjacent the second medical portion 35 thereof. The feeding ports 38, which form a primary portion of the recyclable aggregate feeder assembly 12, are preferably located at spaced intervals around the second medial portion 35 of the mixer drum 14.

Figure 4:
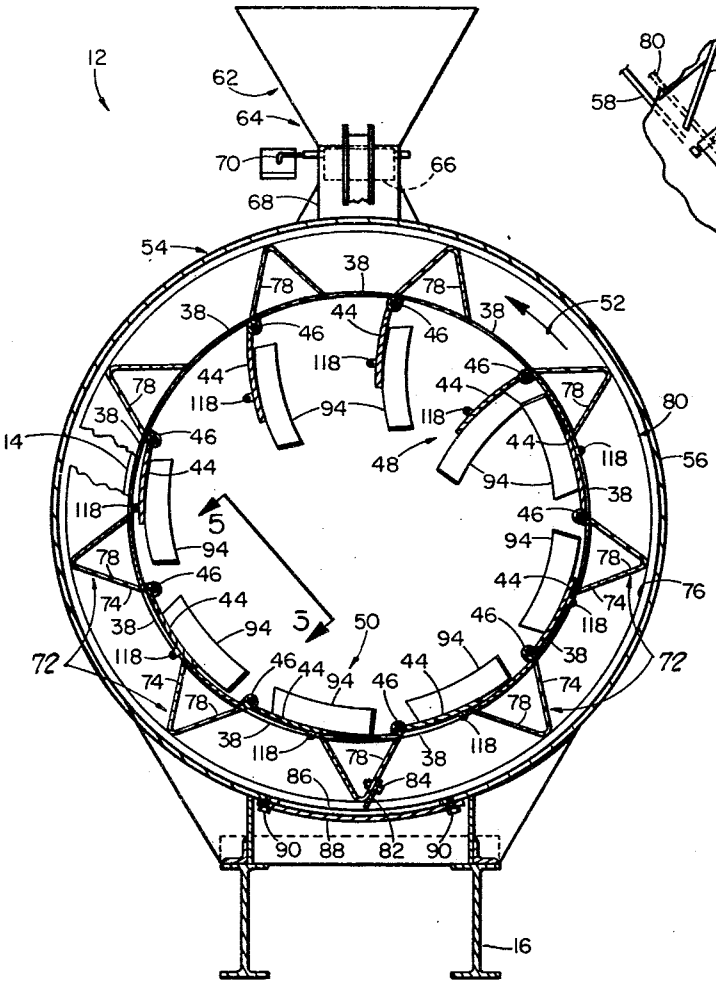
FIG. 4 is a cross sectional view of the mixer taken along the line 4—4 in FIG. 3.
Figure 6:
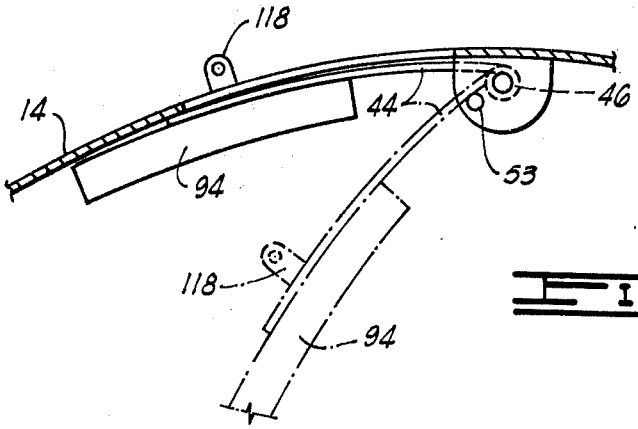
FIG. 6 is a partial sectional view of a preferred form of the feeding port cover of FIG. 4.

Since the operation of the mixer 10 will be most predictable and stable when the mass of aggregate in the mixer drum 14 at any particular time is substantially constant, it is important to insure that aggregate, once introduced into the mixer drum 14, remains in the mixer drum 14 until discharged from an output end 40 thereof via a discharge chute 42. For this reason, the recyclable aggregate feeder assembly 12 includes a plurality of recyclable aggregate feeding port covers 44, each feeding port cover 44 being pivotally connected to the mixer drum 14 adjacent a respective one of the feeding ports 38 via an associated pivot pin 46. As can be seen most clearly in FIG. 4, each of the feeding port covers 44 freely rotates about the associated pivot pin 46 under the influence of gravity between an open position 48 wherein the feeding port cover 44 is disposed generally inwardly of the inner surface of the mixer drum 14 thereby uncovering the associated feeding port 38; and a closed position 50 wherein the feeding port cover 44 is disposed generally coextensively with the inner surface of the mixer drum 14 thereby covering the respective feeding port 38, in response to the rotation of the mixer drum 14 in the normal rotary direction 52. Thus, it can be seen, that each of the feeding port covers 44 will be in the open position 48 only when the associated feeding port 38 is vertically higher than the longitudinal axis of the mixer drum 14, thereby minimizing the possibility of expelling aggregate from the interior of the mixer drum 14 through the feeding ports 38. Preferably, each of the feeding port covers 44 is provided with a stop 53 as shown in FIG. 6 to limit the rotational freedom of the respective feeding port cover 44 to an optimal degree while precluding interference or collision of adjacent feeding port covers 44.

The recyclable aggregate feeder assembly 12 also includes a shroud assembly 54 disposed generally around the second medial portion 35 of the mixer drum 14 and enclosing the recyclable aggregate feeding ports 38. More particularly, the shroud assembly 54 is comprised generally of a cylindrical outer wall 56 which is coaxial with, but has a larger diameter than, the mixer drum 14; and a pair of end walls 58 connected to respective ends of the cylindrical outer wall 56 and extending radially inwardly into proximity with the mixer drum 14. Preferably, high temperature, resilient seals 60 are connected to the end walls 58 to extend into sealing engagement with the mixer drum 14 to minimize undesirable air infiltration into the mixer drum 14.

The shroud assembly 54 has an input hopper portion 62 preferably formed near the vertically upper portion thereof to provide communication with the feeding ports 38 when the associated feeding port covers 44 are in the open position 48. Preferably, the shroud assembly 54 also includes a damper assembly 64 for closing the input hopper portion 62 except when recyclable aggregate is being fed thereinto. In a preferred form, the damper assembly 64 includes a damper 64 pivotally connected to the shroud assembly 54 adjacent to the input hopper portion 62 thereof, so that the damper 66 is movable between an open position opening the input hopper portion 62 and a closed position closing the input hopper portion 62; and some means for biasing the damper 66 toward the closed position thereof. For example, in the embodiment shown in FIGS. 3 and 4, the damper 66 is interposed in a chute portion 68 connecting the input hopper portion 62 to the rest of the shroud assembly 54, and is biased toward the closed position thereof via a conventional weighted lever arm 70 extending from one end thereof.

To facilitate efficient transfer of recyclable aggregate between the input hopper portion 62 and the feeding ports 38, a funnel assembly 72 may be connected to the mixer drum 14 around, and diverging outwardly from, each of the feeding ports 38. As can be best seen in FIG. 4, each of the funnel assemblies 72 is comprised of a pair of inclined guide members 74 extending generally longitudinally of the mixer drum 14 on either side of a respective feeding port 38, and a pair of substantially perpendicular guide members 76 extending generally radially outwardly from the mixer drum 14 adjacent respective ends of the associated feeding port 38. In a preferred form, the inclined guide members 74 of adjacent feeding ports 38 are joined along the distal edges thereof to define a plurality of guide assemblies 78, each having a substantially V-shaped cross section, thereby effectively strengthening the portion of the mixer drum 14 extending between the adjacent feeding ports 38. In an analogous manner, the perpendicular guide members 76 may be conveniently provided in the form of a pair of annular flanges 80 extending radially outwardly from the mixer drum 14 adjacent the respective ends of each of the feeding ports 38 and connected as by welding across the respective ends of the guide assemblies 78.

It has been determined to be desirable to provide a way of periodically scraping the inner surface of the shroud assembly 54 to prevent the formation of deposits on the inner surface thereof. In one form, a scraper plate 82 may be connected to one of the inclined guide members 74 in any convenient manner such as via the bolts 84, so as to extend outwardly into close proximity with the inner surface of the cylindrical wall 56. It is also considered desirable to provide the shroud assembly 54 with a clean-out port 86 near the vertically lower portion thereof, including a removable clean-out port cover 88 connected thereto as by the bolts 90, to facilitate periodic cleaning of the shroud assembly 54 and maintenance of the various elements enclosed within the shroud assembly 54.

To facilitate movement of the aggregate materials within the mixer drum 14, a plurality of flights 92 (only a few of which are shown in FIG. 3 for reasons of simplicity) are connected to the inner surface of the mixer drum 14 for mixing the new and recyclable aggregates with the asphaltic oil in the heated environment present in the mixer drum 14 to form a hot mix asphalt. In the preferred embodiment, each of the feeder port covers 44 has a short flight 94 connected thereto on the side thereof disposed generally inwardly of the mixer drum 14 in the closed position 50. In addition, the frame 16 is provided with a plurality of support legs 96 pivotally connected thereto at spaced intervals therealong so that the mixer drum 14 may be operated with the input end 24 thereof higher than the output end 40 thereof. Thus, the hot mix asphalt will tend to migrate under the influence of gravity toward the output end 40 of the mixer drum 14 for discharge via the discharge outlet 42 disposed adjacent the output end 40 of the mixer drum 14.

If desired, a dust filtration and collection apparatus 98 of conventional construction may be connected in any convenient manner to the output end 40 of the mixer drum 14 via an outlet shroud assembly 100 to minimize the expulsion of pollutants into the surrounding environment. The apparatus 98 will normally include an exhaust fan 101 to furnish secondary air in the usual fashion.

OPERATION OF THE PREFERRED EMBODIMENT

To facilitate transportation of the mixer 10 to a desired operating location, the support legs 96 should be pivoted upwardly relative to the frame 16 to a storage position as shown in full lines in FIG. 1, so that the frame 16 may assume a substantially horizontal position relative to the earth's surface 102. Thereafter, the front end 104 of the frame 16 may be connected in a conventional manner to a tractor or the like with the rear end 106 of the frame 16 being supported via the dual-tandem wheel assembly 108.

Upon arrival at the desired operating location, the mixer 10 may be placed in the operating position by raising the front end 104 of the frame 16 and pivoting the support legs 96 downwardly relatively to the frame 16 into engagement with respective support blocks 110 disposed upon the earth's surface 102*a*, as shown in phantom in FIG. 1. The new aggregate conveyor assembly 28 may then be positioned with the discharge end 112 thereof substantially vertically above the charging hopper 30 to facilitate feeding of the new aggregate into the first end 24 of the mixer drum 14. In a similar manner, the recyclable aggregate conveyor assembly 36 may be positioned with the discharge end 114 thereof substantially vertically above the input hopper portion 62 of the shroud assembly 54 to facilitate feeding of the recyclable aggregate into the second medial portion 35 of the mixer drum 14. In addition, the burner assembly 22 should be connected to a suitable source of fuel (not shown) and appropriately actuated to produce the flame 25 in the mixer drum 14 extending from the first end 24 thereof to the first medial portion 27 thereof; the asphalt injection assembly 32 should be connected to a suitable asphaltic oil reservoir (not shown) providing heated asphaltic oil at a temperature on the order of 300° F.; and the chain drive assembly 20 should be connected to a suitable source of power and placed in an actuated condition to rotate the drum 14 about the longitudinal axis thereof. If dust filtration and collection is desired, the dust filtration and collection apparatus 98 should be actuated in an appropriate, conventional manner.

After the burner assembly 22 has heated the mixer drum 14 to a desired operating temperature, the new aggregate conveyor assembly 28 should be actuated to feed new aggregate into the first end 24 of the mixer drum 14, with the composition of the new aggregate being selected according to job specifications in a well known manner. Thereafter, recyclable aggregate may be fed into the input hopper portion 62 of the shroud assembly 54 via the recyclable aggregate conveyor assembly 36, with the rate of feeding being determined in a conventional manner from the job specifications. Substantially simultaneously, the asphalt injection apparatus 32 should be actuated to inject the heated asphaltic oil into the mixer drum 14 with the point of injection 116 being selected so that the exhaust issuing through the output shroud assembly 100 indicates an acceptable level of combustion of the oil.

As will be clear to those skilled in the art, the recyclable aggregate should preferably be heated to as high a temperature as possible to induce optimum interaction with the asphaltic oil, while at the same time minimizing the combustion of the hydrocarbon portions of both the recyclable aggregate and the asphaltic oil. In the preferred method and apparatus, the new aggregate is repeatedly cascaded through the flame 25, which, with the normal radiant heating, results in substantially superheating the new aggregate. This initial transfer of heat from the flame 25 and the associated combustion gases to the relatively larger mass of new aggregate significantly lowers the average temperature at the point of introduction of the recyclable aggregate without changing the total amount of heat available for heating the recyclable aggregate. Although the recyclable aggregate is exposed to significantly lower temperatures thereby reducing combustion of the hydrocarbon portion thereof, the subsequent mixing of the superheated new aggregate and the heated asphaltic oil with the recyclable aggregate induces sufficient direct heat transfer so that the temperature of the resultant hot mix is well within conventional job specification. Besides acting as a significant medium of heat transfer, the new aggregate effectively shields from the flame 14 the portion of the mixer drum 25 generally between the input end 24 and the first medial portion 27. Simultaneously, the passage of the new aggregate through the flame 25 has a quenching effect thereby tending to confine the flame 25 to the portion of the mixer drum 14 between the input end 24 and the first medial portion 27 thereof.

Although the mixer 10 has been shown and described herein as being operated to recycle old asphaltic aggregate material, it will be clear to those skilled in the art, that the mixer 10 may be operated using new aggregate only. However, to optimize the operation of the mixer 10 in such a mode, it may be desired to inhibit the normal pivoting operation of the feeding port covers 44, such as by inserting retaining bolts or pins (not shown) through holes provided through the perpendicular guide members 76 into engagement with perforated tabs 118 connected to the side of the feeding port cover 44 disposed generally outwardly of the mixer drum 14 in the closed position 50.

Figure 7:
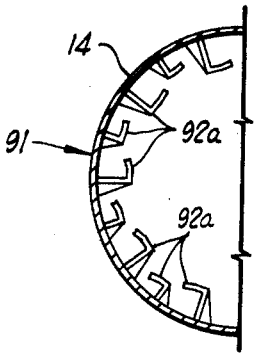
FIG. 7 is a partial sectional view of an alternate form of a portion of the mixer drum.
Figure 8:
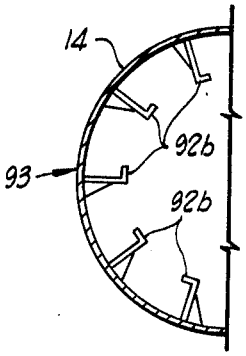
FIG. 8 is a partial sectional view of an alternate form of one other portion of the mixer drum.

DESCRIPTION OF FIGS. 7 and 8

It has been discovered that, under at least some operating conditions, a significant improvement in operation can be obtained by increasing the proportion of the heat introduced into the mixer drum 14 via the flame 25 which is initially transferred to the new aggregate. For example, the temperature of combustion gases in the region of the second medial portion 35 of the mixer drum may be maintained sufficiently low to preclude combustion of significant quantities of the hydrocarbon portion of the recyclable aggregate by increasing the number of exposures of the new aggregate to the flame 25. To accomplish this, the front portion 91 of the mixer drum 14 generally between the input end 24 and the second medial portion 35 thereof may be provided, as shown in FIG. 7, with relatively more lifting flights 92 than the rear portion 93 of the mixer drum 14 generally between the second medial portion 35 and the output end 40, as shown in FIG. 8. In addition, the flights **92*a* in the front portion 91 may be shaped to enhance the cascading action of the new aggregate through the flame 25, while the flights 92*b* in the rear portion 93 may be shaped to induce mixing of the new and recyclable aggregates with the asphaltic oil to form the hot mix asphalt. A further improvement in control may be obtained by varying the pitch of the flights 92 in the front portion 91 relative to the flights 92 in the rear portion 93, so that the speed or rate of movement of the new aggregate from the input end 24 to the first medial portion 27 of the mixer drum 14 is less than the speed or rate of movement of the mixture from the second medial portion 35 toward the output end 40**.

By increasing the time the new aggregate is exposed to the flame 25, the amount of new aggregate used may be decreased, thereby improving the economies of operation. Also, more freedom is thereby allowed in selecting the size gradation of the new aggregate, whereby the final hot mix asphalt produced by the mixer 10 will have the required aggregate gradation to meet the specifications for the paving job being performed.

Figure 9:
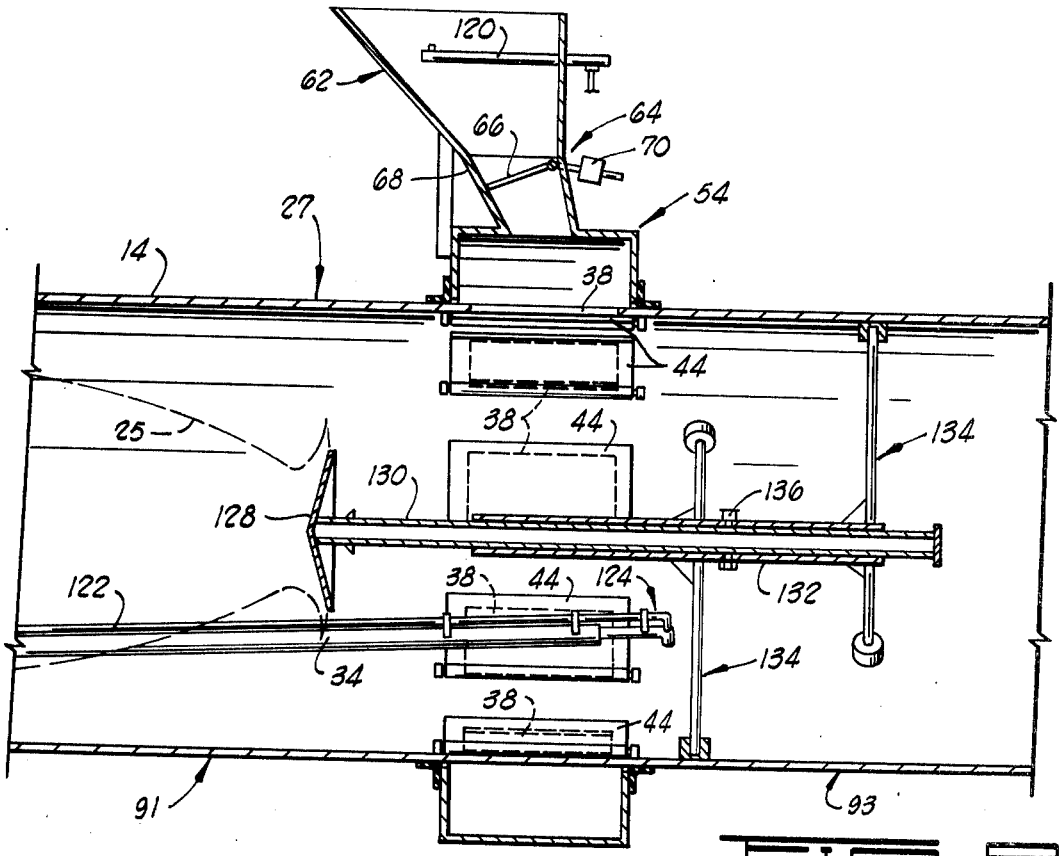
FIG. 9 is a partial sectional view of one other alternate form of the mixer drum, with the mixer drum in simplified form for purposes of clarity.
Figure 10:
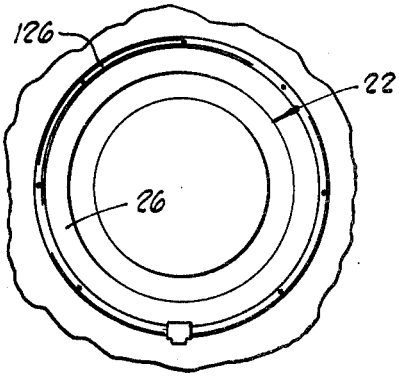
FIG. 10 is an end view of one alternate form of a water injection apparatus in association with the burner assembly.

DESCRIPTION OF FIGS. 9 and 10

It has also been discovered that water may be advantageously employed, generally as a quenching agent, to restrict or control the temperatures in the mixer drum 14. For example, water may be added to the recyclable aggregate, as shown in FIG. 9, as the recyclable aggregate is fed into the mixer drum 14 via a sprayer bar 120 disposed within the input hopper portion 62 of the shroud assembly 54. Alternatively, water may be injected into the mixer drum 14 in association with the asphaltic oil via a water injection conduit 122 connected to the injection nozzle 34 of the asphalt injection assembly 32 as shown at 124 in FIG. 9. In the form shown in FIG. 10, a ring sprayer 126 encircling the pre-ignition and combustion chamber 26 of the burner assembly 22 injects water into the input end 24 of the mixer drum 14 in a curtain around the flame 25, with the resulting water vapor or steam envelope enhancing the quenching action of the cascading new aggregate.

As also shown in FIG. 9, a flame deflector or heat shield 128 may be provided within the mixer drum 14 generally between the first and second medial portions 27 and 35 to substantially preclude direct exposure of the recyclable aggregate to the flame 25. In the illustrated form, the shield 128, of generally conical shape, is connected to one end of a support rod 130 which is telescoped through a sleeve 132 maintained coaxial with the mixer drum 14 via a pair of support webs 134. Prior to operation of the mixer 10, the shield 128 may be manually positioned at a desired position relative to the second medial portion 35 via a retaining bolt 136 extending through the rod 130 and the sleeve 132. In this form, the shield 128 and associated support components can be quickly and easily configured to operate with a particular mix of new and recyclable aggregate, yet will have no substantial degrading effect on the production capacity or efficiency of the mixer 10 in conventional mix operations.

From the above, it can readily be seen that the mixer 10 as constructed in accordance with the preferred embodiment of the present invention, provides a convenient and effective means for utilizing recyclable aggregate in the production of hot mix asphalt. However, it must be recognized that various changes may be made in the construction and the arrangement of the parts or elements or the steps of the method of the present invention as disclosed herein without departing from the spirit and scope of the invention as defined in the following claims.

What is claimed is:

1. Apparatus for producing hot mix asphalt utilizing new aggregate and a previously manufactured and laid asphalt mix which has been reduced to form recyclable aggregate, comprising:

a cylindrical mixer drum having an input end, an output end, and a recyclable aggregate feeding port extending radially through a medial portion thereof;

means supporting the mixer drum for rotation about the longitudinal axis thereof with the input end of the mixer drum higher than the output end of the mixer drum;

means at the input end of the mixer drum for producing a flame in the mixer drum extending from the input end of the mixer drum to a medial portion of the mixer drum;

a recyclable aggregate feeding port cover pivotally connected to the mixer drum adjacent the recyclable aggregate feeding port therethrough, the recyclable aggregate feeding port cover rotating under the influence of gravity between an open position uncovering the recyclable aggregate feeding port and a closed position covering the recyclable aggregate feeding port in response to the rotation of the mixer drum;

a shroud assembly disposed around the medial portion of the mixer drum and enclosing the recyclable aggregate feeding port, the shroud assembly having an input hopper portion communicating with the recyclable aggregate feeding port when the recyclable aggregate feeding port cover is in the open position thereof;

recyclable aggregate conveyor means for feeding the recyclable aggregate into the input hopper portion of the shroud assembly;

new aggregate conveyor means for feeding the new aggregate into the input end of the mixer drum;

asphalt injection means for injecting asphaltic oil into the mixer drum;

flight means connected to the inner periphery of the mixer drum for moving the new aggregate and recyclable aggregate around the mixer drum and mixing the asphaltic oil, new aggregate and recyclable aggregate within the mixer drum to form a hot mix asphalt; and means for discharging the hot mix asphalt from the output end of the mixer drum.

2. The apparatus of claim 1 wherein the shroud assembly is further characterized as including damper means for closing the input hopper portion except when recyclable aggregate is fed thereinto.

3. The apparatus of claim 2 wherein the damper means are further defined to include:

a damper connected to the shroud assembly adjacent to the input hopper portion thereof, the damper being movable between an open position opening the input hopper portion and a closed position closing the input hopper portion; and means for biasing the damper toward the closed position thereof.

4. The apparatus of claim 2 wherein the shroud assembly is further characterized as having the input hopper portion formed near the vertically upper portion thereof, the shroud assembly being provided with a clean-out port near the vertically lower portion thereof, including a removable clean-out port cover.

5. The apparatus of claim 1 wherein the recyclable aggregate feeding port cover is further characterized as having a flight connected thereto on the side thereof disposed inwardly of the mixer drum in the closed position of the recyclalbe aggregate feeding port cover.

6. The apparatus of claim 1 further defined to include a funnel assembly connected to the mixer drum around, and diverging outwardly from, the recyclable aggregate feeding port.

7. The apparatus of claim 6 wherein the funnel assembly is further defined to include a pair of inclined guide members extending generally longitudinally of the mixer drum on either side of the recyclable aggregate feeding port, and a pair of substantially perpendicular guide members extending generally radially outwardly from the mixer drum adjacent respective ends of the recyclable aggregate feeding port.

8. The apparatus of claim 7 wherein the mixer drum is further characterized as having a plurality of the recyclable aggregate feeding ports extending radially through the medial portion thereof at spaced intervals therearound; wherein a recyclable aggregate feeding port cover is pivotally connected to the mixer drum adjacent to each of the recyclable aggregate feeding ports; wherein a funnel assembly is connected around, and diverges outwardly from, each of the recyclable aggregate feeding ports; wherein the inclined guide member portions of the funnel assemblies of adjacent recyclable aggregate feeding ports are joined along the distal edges thereof to define guide assemblies having substantially V-shaped cross section; and wherein the vertical guide member portions of the funnel assmeblies comprise portions of a pair of annular flanges extending radially outwardly from the mixer drum adjacent the respective ends of the recyclable aggregate feeding ports and across the respective ends of the guide assemblies.

9. The apparatus of claim 7 further defined to include a scraper plate connected to the inclined guide members and extending outwardly into close proximity with the inner surface of the shroud assembly.

10. The apparatus of claim 1 further defined to include means for preventing the formation of deposits on the inner surface of the shroud assembly.

11. The apparatus of claim 1 wherein the flight means are further defined as lifting flights connected to the inner periphery of the mixer drum, and wherein relatively more of said flights are connected to the inner periphery of the portion of the mixer drum generally between the input end thereof and the recyclable aggregate feeding port than are connected to the inner periphery of the portion of the mixer drum generally between the recyclable aggregate feeding port and the output end thereof.

12. The apparatus of claim 1 wherein the flight means are further characterized as including means in the portion of the mixer drum generally between the input end thereof and the recyclable aggregate feeding port for cascading the new aggregate through the flame, and means in the portion of the mixer drum generally between the recyclable aggregate feeding port in the output end thereof for mixing the new aggregate, recyclable aggregate and asphaltic oil while moving the mixture toward the output end of the mixer drum.

13. The apparatus of claim 1 wherein the flight means are further characterized as moving the new aggregate from the input end of the mixer drum to the recyclable aggregate feeding port at a rate less than the rate of movement of the mixture of the new aggregate, recyclable aggregate and asphaltic oil from the recyclable aggregate feeding port toward the output end of the mixer drum.

14. The apparatus of claim 1 further defined to include:

water injection means for injecting water into the recyclable aggregate as the recyclable aggregate is fed into the mixer drum.

15. The apparatus of claim 1 further defined to include:

water injection means for injecting water into the mixer drum with the asphaltic oil.

16. The apparatus of claim 1 further defined to include:

water injection means for injecting water into the mixer drum in a curtain around the flame.

17. The apparatus of claim 1 further defined to include:

heat shield means disposed in the mixer drum generally between the input end thereof and the recyclable aggregate feeding port for shielding the recyclable aggregate from the flame.

18. The apparatus of claim 17 wherein the heat shield means are further characterized as being adjustably positionable relative to the mixer drum.

19. Apparatus for producing hot mix asphalt utilizing new aggregate and a previously manufactured and laid asphalt mix which has been reduced to form recyclable aggregate, comprising:

a cylindrical mixer drum having an input end, an output end, and a recyclable aggregate feeding port extending radially through a medial portion thereof;

means supporting the mixer drum for rotation about the longitudinal axis thereof with the input end of the mixer drum higher than the output end of the mixer drum;

means at the input end of the mixer drum for producing a flame in the mixer drum extending from the input end of the mixer drum to a medial portion of the mixer drum;

a shroud assembly disposed around the medial portion of the mixer drum and enclosing the recyclable aggregate feeding port, the shroud assembly having an input hopper portion communicating with the recyclable aggregate feeding port in one position thereof;

recyclable aggregate conveyor means for feeding the recyclable aggregate into the input hopper portion of the shroud assembly;

new aggregate conveyor means for feeding the new aggregate into the input end of the mixer drum;

asphalt injection means for injecting asphaltic oil into the mixer drum;

flight means connected to the inner periphery of the mixer drum for moving the new aggregate and recyclable aggregate around the mixer drum and mixing the asphaltic oil, new aggregate and recyclable aggregate within the mixer drum to form a hot mix asphalt;

means for discharging the hot mix asphalt from the output end of the mixer drum; and a recyclable aggregate feeding port cover pivotally connected to the mixer drum adjacent the recyclable aggregate feeding port therethrough, the recyclable aggregate feeding port cover rotating under the influence of gravity between an open position uncovering the recyclable aggregate feeding port and a closed position covering the recyclable aggregate feeding port in response to the rotation of the mixer drum.

20. A method for producing hot mix asphalt utilizing new aggregate and a previously manufactured and laid asphalt mix which has been reduced to form recyclable aggregate, the method employing a cylindrical mixer drum having lifting flights around the inner periphery thereof between an input end and an output end thereof, the method comprising the steps of:

rotating the mixer drum about the longitudinal axis thereof;

producing a flame in the mixer drum extending from the input end of the mixer drum to a first medial portion of the mixer drum;

feeding the new aggregate into the input end of the mixer drum;

cascading the new aggregate repeatedly through the flame while simultaneously moving the new aggregate toward the output end of the mixer drum, whereby the new aggregate substantially shields the mixer from the flame between the input end and the first medial portion of the mixer drum and simultaneously confines the flame to the portion of the mixer drum between the input end and the first medial portion thereof;

feeding the recyclable aggregate radially into the mixer drum at a second medial portion thereof intermediate the first medial portion and output end thereof;

injecting asphaltic oil into the mixer drum adjacent the second medial portion thereof;

mixing the asphaltic oil, new aggregate and recyclable aggregate within the mixer drum while simultaneously moving the mixture thereof toward the output end of the mixer drum, the speed of movement of the new aggregate from the input end to the first medial portion of the mixer drum being less than the speed of movement of the mixture toward the output end of the mixer drum; and discharging the mixture as a hot mix asphalt from the output end of the mixer drum.

21. A method for producing hot mix asphalt utilizing new aggregate and a previously manufactured and laid asphalt mix which has been reduced to form recyclable aggregate, the method employing a cylindrical mixer drum having lifting flights around the inner periphery thereof between an input end and an output end thereof, the method comprising the steps of:

rotating the mixer drum about the longitudinal axis thereof;

producing a flame in the mixer drum extending from the input end of the mixer drum to a first medial portion of the mixer drum;

feeding the new aggregate into the input end of the mixer drum;

cascading the new aggregate repeatedly through the flame while simultaneously moving the new aggregate toward the output end of the mixer drum, whereby the new aggregate substantially shields the mixer from the flame between the input end and the first medial portion of the mixer drum and simultaneously confines the flame to the portion of the mixer drum between the input end and the first medial portion thereof;

feeding the recyclable aggregate radially into the mixer drum at a second medial portion thereof intermediate the first medial portion and output end thereof;

injecting asphaltic oil into the mixer drum adjacent the second medial portion thereof;

injecting water into the mixer drum with the asphaltic oil;

mixing the asphaltic oil, new aggregate and recyclable aggregate within the mixer drum while simultaneously moving the mixture thereof toward the output end of the mixer drum; and discharging the mixture as a hot mix asphalt from the output end of the mixer drum.

22. A method for producing hot mix asphalt utilizing new aggregate and a previously manufactured and laid asphalt mix which has been reduced to form recyclable aggregate, the method employing a cylindrical mixer drum having lifting flights around the inner periphery thereof between an input end and an output end thereof, the method comprising the steps of:

rotating the mixer drum about the longitudinal axis thereof;

producing a flame in the mixer drum extending from the input end of the mixer drum to a first medial portion of the mixer drum;

feeding the new aggregate into the input end of the mixer drum;

cascading the new aggregate repeatedly through the flame while simultaneously moving the new aggregate toward the output end of the mixer drum, whereby the new aggregate substantially shields the mixer from the flame between the input end and the first medial portion of the mixer drum and simultaneously confines the flame to the portion of the mixer drum between the input end and the first medial portion thereof;

feeding the recyclable aggregate radially into the mixer drum at a second medial portion thereof intermediate the first medial portion and output end thereof;

injecting asphaltic oil into the mixer drum adjacent the second medial portion thereof;

injecting water into the mixer drum in a curtain around the flame to form a water vapor envelope therearound;

mixing the asphaltic oil, new aggregate and recyclable aggregate within the mixer drum while simultaneously moving the mixture thereof toward the output end of the mixer drum; and discharging the mixture as a hot mix asphalt from the output end of the mixer drum.

23. A method for producing hot mix asphalt utilizing new aggregate and a previously manufactured and laid asphalt mix which has been reduced to form recyclable aggregate, the method employing a cylindrical mixer drum having lifting flights around the inner periphery thereof between an input end and an output end thereof, the method comprising the steps of:

rotating the mixer drum about the longitudinal axis thereof;

producing a flame in the mixer drum extending from the input end of the mixer drum to a first medial portion of the mixer drum;

feeding the new aggregate into the input end of the mixer drum;

cascading the new aggregate repeatedly through the flame while simultaneously moving the new aggregate toward the output end of the mixer drum, whereby the new aggregate substantially shields the mixer from the flame between the input end and the first medial portion of the mixer drum and simultaneously confines the flame to the portion of the mixer drum between the input end and the first medial portion thereof;

feeding the recyclable aggregate radially into the mixer drum at a second medial portion thereof intermediate the first medial portion and output end thereof;

injecting asphaltic oil into the mixer drum adjacent the second medial portion thereof;

mixing the asphaltic oil, new aggregate and recyclable aggregate within the mixer drum while simultaneously moving the mixture thereof toward the output end of the mixer drum, the speed of rotation of the mixer drum being substantially constant while the speed of movement of the new aggregate from the input end of the mixer drum to the first medial portion thereof is decreased relative to the speed of movement of the mixture toward the output end of the mixer drum, whereby the number of times the new aggregate is cascaded through the flame is increased; and discharging the mixture as a hot mix asphalt from the output end of the mixer drum.

* * * * *

UNITED STATES PATENT OFFICE

CERTIFICATE OF CORRECTION

Patent No. 4,147,436 Dated April 3, 1979

Inventor(s) David L. Garbelman, William H. Minor and Arthur G. Shaw

It is certified that error appears in the above-identified patent and that said Letters Patent are hereby corrected as shown below:

Column 5, line 9, "64", second occurrence, read -- 66 --.

Column 10, line 46, "assemblies" should be --assemblies--.

Column 4, line 16, "medical" should be --medial--.

Column 7, line 38, "14" should be --25--.

Column 7, line 39, "25" should be --14--.

Signed and Sealed this

*Eighteenth* Day of *September 1979*

[SEAL]

*Attest:*

*Attesting Officer*

LUTRELLE F. PARKER

*Acting Commissioner of Patents and Trademarks*